US009840682B2

(12) United States Patent
Si et al.

(10) Patent No.: US 9,840,682 B2
(45) Date of Patent: Dec. 12, 2017

(54) CLEANING COMPOSITIONS WITH IMPROVED SUDSING PROFILE COMPRISING A CATIONIC POLYMER AND SILICONE MIXTURE

(71) Applicant: The Procter & Gamble Company, Cincinnati, OH (US)

(72) Inventors: Gang Si, Beijing (CN); Rajan Keshav Panandiker, West Chester, OH (US); Dongyan Qin, Beijing (CN); Meng Chen, Beijing (CN); Yang Zhang, San Diego, CA (US); Qi Zhang, Beijing (CN); Bernard William Kluesener, Harrison, OH (US); Raul Rodrigo Gomez, Brussels (BE); Rebecca Ann Langevin, Norwood, OH (US); Ming Tang, Beijing (CN); Koushik Mukherjee, Beijing (CN); Peng Qin, Beijing (CN); Mark Robert Sivik, Cincinnati, OH (US); Susanne Birkel, Darmstadt (DE); Aaron Flores-Figueroa, Mannheim (DE)

(73) Assignee: The Procter & Gamble Company, Cincinnati, OH (US)

( * ) Notice: Subject to any disclaimer, the term of this patent is extended or adjusted under 35 U.S.C. 154(b) by 119 days.

(21) Appl. No.: 14/937,910

(22) Filed: Nov. 11, 2015

(65) Prior Publication Data

US 2016/0130528 A1 May 12, 2016

(30) Foreign Application Priority Data

Nov. 11, 2014 (WO) ..... PCT/CN2014/090775
Sep. 25, 2015 (WO) ..... PCT/CN2015/090649

(51) Int. Cl.

| | |
|---|---|
| ***C11D 3/37*** | (2006.01) |
| ***C11D 9/36*** | (2006.01) |
| ***C11D 3/00*** | (2006.01) |

(52) U.S. Cl.

CPC ..... *C11D 3/0026* (2013.01); *C11D 3/373* (2013.01); *C11D 3/3769* (2013.01); *C11D 3/3773* (2013.01)

(58) Field of Classification Search

CPC ..... C11D 3/001; C11D 3/0026; C11D 3/124; C11D 3/162; C11D 3/37; C11D 3/3719; C11D 3/373; C11D 3/3734; C11D 9/225; C11D 9/36; C11D 11/0017

See application file for complete search history.

(56) References Cited

U.S. PATENT DOCUMENTS

| | | | | |
|---|---|---|---|---|
| 4,983,383 | A | 1/1991 | Maksimoski et al. | |
| 5,723,426 | A | 3/1998 | Zhen et al. | |
| 5,759,208 | A | 6/1998 | Zhen et al. | |
| 6,733,538 | B1 | 5/2004 | Panandiker et al. | |
| 7,566,750 | B2 | 7/2009 | Rautschek et al. | |
| 8,193,141 | B2 | 6/2012 | Corona, III et al. | |
| 8,372,795 | B2 | 2/2013 | Corona, III et al. | |
| 8,450,263 | B2 | 5/2013 | Panandiker et al. | |
| 8,536,109 | B2 | 9/2013 | Delbrassinne et al. | |
| 8,980,239 | B2 | 3/2015 | Staudigel et al. | |
| 2008/0089856 | A1 | 4/2008 | Kolly-Hernandez et al. | |
| 2008/0229519 | A1* | 9/2008 | Depoot | C11D 3/227 8/401 |
| 2008/0234165 | A1 | 9/2008 | Panandiker et al. | |
| 2008/0242584 | A1 | 10/2008 | Wahl et al. | |
| 2011/0209291 | A1 | 9/2011 | Sadlowski et al. | |
| 2012/0083438 | A1* | 4/2012 | Panandiker | C11D 1/02 510/332 |
| 2012/0309663 | A1 | 12/2012 | Panandiker et al. | |
| 2013/0089587 | A1* | 4/2013 | Staudigel | A61Q 5/12 424/401 |
| 2014/0023609 | A1 | 1/2014 | Mukherjee et al. | |
| 2015/0093349 | A1 | 4/2015 | Panandiker et al. | |

FOREIGN PATENT DOCUMENTS

| | | | |
|---|---|---|---|
| WO | WO 2012/075962 | A1 | 6/2002 |
| WO | WO 2005/087907 | A1 | 9/2005 |
| WO | WO 2008/110590 | A1 | 9/2008 |
| WO | WO 2009/095823 | A1 | 8/2009 |

OTHER PUBLICATIONS

PCT Search Report for International application No. PCT/CN2014/090775, dated Aug. 19, 2015 containing 5 pages.
PCT International Search Report for application No. PCT/CN201S/090649, dated Apr. 5, 2017, 15 pages.

* cited by examiner

*Primary Examiner* — Charles Boyer
(74) *Attorney, Agent, or Firm* — Gregory S. Darley-Emerson; Leonard W Lewis; Steven W Miller

(57) ABSTRACT

The present invention relates to detergent or cleaning compositions with improved sudsing profile, which comprise a cationic polymer, an organomodified silicone and a siloxane-based diluent.

21 Claims, No Drawings

CLEANING COMPOSITIONS WITH IMPROVED SUDSING PROFILE COMPRISING A CATIONIC POLYMER AND SILICONE MIXTURE

FIELD OF THE INVENTION

The present invention relates to detergent or cleaning products, more preferably liquid laundry detergent products, and most preferably products that can be used for hand-washing fabrics. The detergent or cleaning products of the present invention contain foam control agents, namely a cationic polymer, an organomodified silicone and a siloxane-based diluent, and exhibit surprising and unexpected improvements in their sudsing profiles.

BACKGROUND OF THE INVENTION

Sudsing profile is important for a cleaning composition, particularly laundry detergents, where the appropriate volume and speed of suds formation, retention and disappearance in the wash and rinse cycles are considered key benchmarks of performance by the consumers.

Consumers viewed copious suds in the wash as the primary and most desirable signal of cleaning. High suds are especially desirable during hand washing of fabrics, since the consumer can directly feel and touch the suds generated during the wash cycle and will intuitively correlates the high suds volume with the achievement of sufficient fabric cleaning.

Paradoxically, while a large volume of suds is desirable during the wash cycle of fabric cleaning, it is nevertheless undesirable during the rinse cycle. If such high suds are still present during rinse, then the consumers immediately infer from it that there may still be surfactant residue on the fabrics and that the fabrics are not yet "clean". As a result, the consumers feel the need to rinse the fabrics multiple times in order to make sure that the surfactants are removed as thoroughly as other soils. Because water is often a limited resource, especially in hand washing countries, the excess amount of water consumed by multiple rinses reduces the amount of water available for other possible uses, such as irrigation, drinking, bathing, etc.

Various foam-control or anti-foaming agents have been added to detergent for cleaning compositions to control and reduce the suds volume during the wash. For example, U.S. Pat. No. 8,536,109 (Dow Corning) discloses a foam control composition that contains a silicone anti-foam dispersed in an organopolysiloxane resin, wherein the silicone anti-foam includes an organopolysiloxane, an organosilicon resin, and a hydrophobic filler; U.S. Pat. No. 7,566,750 (Wacker) discloses a defoamer composition containing an organopolysiloxane, filler particles and/or an organopolysiloxane resin, and a very minor amount of added water, which is more effective in reducing the foam or suds volume.

However, the suds control benefit imparted by such foam control or anti-foaming agents may come at the expense of wash suds. Timing for release of the foam control or anti-foam agents is difficult to control. Correspondingly, inopportune release of the foam control or anti-foam agents may lead to significant reduction of the wash suds volume, which will give consumer the impression that the detergent or cleaning composition contains lower surfactant level and is therefore of lower quality/value.

Accordingly, there is a continuing need for better foam control or anti-foaming compositions that can further improve or optimize the sudsing profile of detergent or cleaning compositions, by achieving significant rinse suds reduction but at little or no expense to the wash suds, i.e., minimizing the wash suds reduction.

It would also be advantageous to formulate an improved detergent or cleaning composition that can generate ample suds during the wash cycle to delight the consumers but leaves little or no suds during the rinse cycle to enable a "single rinse" of the fabric for more cost saving and better environmental conservation.

SUMMARY OF THE INVENTION

The present invention discovers that a detergent or cleaning composition, especially a liquid laundry detergent composition, containing the combination of a cationic polymer with an organomodified silicone having one or more aryl moieties and a siloxane-based diluent having a Solubility Index of from 0.8 to 1.25 in the organomodified silicone (measured according to the test method described hereinafter) exhibits surprising and unexpected synergistic improvement in its sudsing profile. Specifically, the cationic polymer comprises a first nonionic structural unit derived from (meth)acrylamide (AAm), and a second cationic structural unit derived from an amine-containing monomer. The detergent or cleaning composition of the present invention is characterized by significant suds reduction during the rinsing cycle but little or no suds reduction during the washing cycle, in comparison with detergent or cleaning compositions that do not contain the above-described cationic polymer, organomodified silicone, and/or siloxane-based diluent. In certain embodiments, the detergent or cleaning compositions are characterized by an optimized sudsing profile sufficient to enable the "single rinse" concept.

In one aspect, the present invention relates to a detergent or cleaning composition containing: (a) a cationic polymer including a first nonionic structural unit derived from (meth) acrylamide (AAm) and a second cationic structural unit derived from an amine-containing monomer; (b) an organomodified silicone comprising one or more aryl moieties each including a 5- to 9-membered aromatic ring, wherein said aromatic ring can be either substituted or unsubstituted, either heteroatomic or homoatomic, either monocyclic or multicyclic; and (c) a siloxane-based diluent having a Solubility Index of from 0.8 to 1.25 in said organomodified silicone. In a preferred embodiment of the present invention, the detergent or cleaning composition further comprises hydrophobically modified silica, a silicone resin, and optionally an emulsifier.

In another aspect, the present invention relates to a detergent or cleaning composition containing: (a) from about 0.1% to about 1% by weight of a cationic polymer, which is an AAm/DADMAC copolymer or an AAm/DADMAC/VP terpolymer; (b) from about 0.2% to about 0.5% by weight of an organomodified silicone, which contains from about 10 mol % to about 40 mol % of siloxane units containing a 2-phenylpropyl moiety and from about 3 mol % to about 10 mol % of siloxane units containing a $C_6$-$C_{10}$ alkyl moiety; (c) from about 0.2% to about 0.5% by weight of a siloxane-based diluent having a Solubility Index of from 0.85 to 1 in the afore-mentioned organomodified silicone, while the siloxane-based diluent includes a first polydimethylsiloxane polymer having a first, higher viscosity ranging from 8 cSt to 12 cSt and a second polydimethylsiloxane polymer having a second, lower viscosity ranging from 5 cSt to 10 cSt, when measured at a shear rate of 20 $sec^{-1}$ and 25° C.; (d) from 0.02% to 0.05% by weight of a hydrophobically modified silica; and (e) from 0.01% to 0.05% by weight of a silicone resin.

The detergent or cleaning composition of the present invention may further contain one or more surfactants selected from the group consisting of anionic surfactants, nonionic surfactants, cationic surfactants, amphoteric surfactants, zwitterionic surfactants, and combinations thereof. The detergent or cleaning composition of the present invention is preferably a laundry detergent product and more preferably a liquid laundry detergent product.

Still another aspect of the present invention relates to the use of a detergent or cleaning composition as described hereinabove for hand-washing fabric to achieve optimized sudsing profile.

These and other features of the present invention will become apparent to one skilled in the art upon review of the following detailed description when taken in conjunction with the appended claims.

DETAILED DESCRIPTION OF THE INVENTION

Definitions

As used herein, the articles "a" and "an" when used in a claim, are understood to mean one or more of what is claimed or described.

As used herein, the terms "comprising," "comprises," "include", "includes" and "including" are meant to be non-limiting.

As used herein, the term "substantially free of" or "substantially free from" means that the indicated material is present in an amount of no more than about 5 wt %, preferably no more than about 2%, and more preferably no more than about 1 wt %.

As used therein, the term "essentially free of" or "essentially free from" means that the indicated material is at the very minimal not deliberately added to the composition, or preferably not present at an analytically detectable level in such composition. It may include compositions in which the indicated material is present only as an impurity of one or more of the materials deliberately added to such compositions.

As used herein, the term "solid" includes granular, powder, bar and tablet product forms.

As used herein, the term "fluid" includes liquid, gel, paste and gas product forms.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$.

All temperatures herein are in degrees Celsius (° C.) unless otherwise indicated. Unless otherwise specified, all measurements herein are conducted at 25° C. and under the atmospheric pressure.

As used herein the phrase "detergent composition," "cleaning composition" or "detergent or cleaning composition" includes compositions and formulations designed for cleaning soiled material. Such compositions include but are not limited to, laundry detergent or cleaning compositions, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The cleaning compositions may have a form selected from liquid, powder, single-phase or multiphase unit dose, pouch, tablet, gel, paste, bar, or flake. In a preferred embodiment of the present invention, the detergent or cleaning composition of the present invention is a liquid laundry detergent or cleaning composition. More preferably, the detergent or cleaning composition is in a single phase or multiphase unit dose form, e.g., a liquid laundry detergent or cleaning composition that is contained in a single compartment or multi-compartment water-soluble pouch, e.g., formed by a water-soluble polymer such as poly-vinyl alcohol (PVA) or copolymers thereof.

As used herein, the term "laundry detergent" means a liquid or solid composition, and includes, unless otherwise indicated, granular or powder-form all-purpose or "heavy-duty" washing agents, especially cleaning detergents as well as cleaning auxiliaries such as bleach additives or pre-treat types. In a preferred embodiment of the present invention, the laundry detergent is a liquid laundry detergent or cleaning composition.

As used herein, "suds" indicates a non-equilibrium dispersion of gas bubbles in a relatively smaller volume of a liquid. The terms like "suds", "foam" and "lather" can be used interchangeably within the meaning of the present invention.

As used herein, "sudsing profile" refers to the properties of a detergent composition relating to suds character during the wash and rinse cycles. The sudsing profile of a detergent composition includes, but is not limited to, the speed of suds generation upon dissolution in the laundering liquor, the volume and retention of suds in the wash cycle, and the volume and disappearance of suds in the rinse cycle. Preferably, the sudsing profile includes the Wash Suds Index and Rinse Suds Index, as specifically defined by the testing methods disclosed hereinafter in the examples. It may further include additional suds-related parameters, such as suds stability measured during the washing cycle and the like.

As used herein, the term "molecular weight" refers to the weight average molecular weight of the polymer chains in a polymer composition. Further, the "weight average molecular weight" ("Mw") may be calculated using the equation:

$$Mw=(\Sigma iNiMi^2)/(\Sigma iNiMi)$$

where Ni is the number of molecules having a molecular weight Mi. The weight average molecular weight must be measured by the method described in the Test Methods section.

As used herein "mol %" refers to the relative molar percentage of a particular monomeric structural unit in a polymer. It is understood that within the meaning of the present invention, the relative molar percentages of all monomeric structural units that are present in the cationic polymer shall add up to 100 mol %.

As used herein, the term "derived from" refers to monomeric structural unit in a polymer that can be made from a compound or any derivative of such compound, i.e., with one or more substituents. Preferably, such structural unit is made directly from the compound in issue. For example, the term "structural unit derived from (meth)acrylamide" refers to monomeric structural unit in a polymer that can be made from (meth)acrylamide, or any derivative thereof with one or more substituents. Preferably, such structural unit is made directly from (meth)acrylamide.

As used herein, the term "(meth)acrylamide" refers to either methacrylamide or acrylamide, and it is abbreviated herein as "AAm." Similarly, the term "meth(acrylate)" refer to either methacrylate or acrylate, and it can be abbreviated herein as "AA."

The term "ammonium salt" or "ammonium salts" as used herein refers to various compounds selected from the group consisting of ammonium chloride, ammonium fluoride, ammonium bromide, ammonium iodine, ammonium bisulfate, ammonium alkyl sulfate, ammonium dihydrogen phosphate, ammonium hydrogen alkyl phosphate, ammonium dialkyl phosphate, and the like. For example, the diallyl dimethyl ammonium salts as described herein include, but are not limited to: diallyl dimethyl ammonium chloride (DADMAC), diallyl dimethyl ammonium fluoride, diallyl dimethyl ammonium bromide, diallyl dimethyl ammonium iodine, diallyl dimethyl ammonium bisulfate, diallyl dimethyl ammonium alkyl sulfate, diallyl dimethyl ammonium dihydrogen phosphate, diallyl dimethyl ammonium hydrogen alkyl phosphate, diallyl dimethyl ammonium dialkyl phosphate, and combinations thereof. Preferably but not necessarily, the ammonium salt is ammonium chloride.

As used herein, the term "acrylate," "acrylates," "methacrylate," and "methacrylates" refers to both the acid forms as well as the salt forms of acrylic acid and methacrylic acid. Salts of acrylic acid and methacrylic acid include, but are not limited to: sodium (meth)acrylates, potassium (meth)acrylates, lithium (meth)acrylates, magnesium (meth)acrylates, calcium (meth)acrylates, aluminum (meth)acrylates, and the like. Preferably but not necessarily, the acrylate or methacrylate is sodium (meth)acrylate.

As used herein, term "substituted" is defined herein as encompassing moieties or units which can replace a hydrogen atom, two hydrogen atoms, or three hydrogen atoms of a hydrocarbyl moiety, inter alia, aromatic ring, alkyl chain, and the like. When a moiety is described a "substituted" any number of the hydrogen atoms may be replaced. For example, a substituted unit that requires a single hydrogen atom replacement includes halogen, hydroxyl, and the like. A two hydrogen atom replacement includes carbonyl, oximino, and the like. A two hydrogen atom replacement from adjacent carbon atoms includes epoxy, and the like. A three hydrogen replacement includes cyano, and the like. An epoxide unit is an example of a substituted unit which requires replacement of a hydrogen atom on adjacent carbons. Also substituted can include replacement of hydrogen atoms on two adjacent carbons to form a new moiety or unit.

As used herein, the term "hydrocarbyl" is defined herein as any organic unit or moiety which is comprised of carbon atoms and hydrogen atoms. Included within the term hydrocarbyl are heterocycles. Included with the definition of "hydrocarbyl" are the aromatic (aryl) and non-aromatic carbocyclic rings. The term "heterocycle" includes both aromatic (heteroaryl) and non-aromatic heterocyclic rings.

In all embodiments of the present invention, all percentages are by weight of the total composition, unless specifically stated otherwise. All ratios are weight ratios, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

It is understood that the test methods that are disclosed in the Test Methods Section of the present application must be used to determine the respective values of the parameters of Applicants' inventions are described and claimed herein.

Cationic Polymer

The cationic polymer used in the present invention is a copolymer that consists of at least two types of structural units. The structural units, or monomers, can be incorporated in the cationic polymer in a random format or can be in a blocky format.

In a particularly preferred embodiment of the present invention, such cationic polymer is a copolymer that contains only the first and second structural units as described hereinabove, i.e., it is substantially free of any other structural components, either in the polymeric backbone or in the side chains. In another preferred embodiment of the present invention, such cationic polymer is a terpolymer that contains only the first and second structural units as described hereinabove and an additional third structural unit, substantially free of any other structural components. Alternatively, it can include one or more additional structural units besides the first, second and third structural units described hereinabove.

The first nonionic structural unit in the cationic polymer of the present invention is derived from (meth)acrylamide (AAm). Preferably, the cationic polymer contains from about 5 mol % to about 99 mol %, preferably from about 25 mol % to about 98 mol %, more preferably from about 45 mol % to about 97 mol %, and most preferably from about 60 mol % to about 96 mol %, of the AAm-derived structural unit.

The second structural unit in the cationic polymer is a cationic structural unit that can be derived from any suitable water-soluble cationic ethylenically unsaturated monomer, such as, for example, N,N-dialkylaminoalkyl methacrylate, N,N-dialkylaminoalkyl acrylate, N,N-dialkylaminoalkyl acrylamide, N,N-dialkylaminoalkylmethacrylamide, methacylamidoalkyl trialkylammonium salts, acrylamidoalkyltrialkylamminium salts, vinylamine, vinyl imidazole, quaternized vinyl imidazole and diallyl dialkyl ammonium salts.

Preferably, the second cationic structural unit is derived from an amine-containing monomer selected from the group consisting of diallyl dimethyl ammonium salts (DADMAS), N,N-dimethyl aminoethyl acrylate, N,N-dimethyl aminoethyl methacrylate (DMAM), [2-(methacryloylamino)ethyl] tri-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), and quaternized vinylimidazole (QVi).

More preferably, the second cationic structural unit is derived from a diallyl dimethyl ammonium salt (DADMAS), as described hereinabove.

Alternatively, the second cationic structural unit can be derived from a [2-(methacryloylamino)ethyl]tri-methylammonium salt, such as, for example, [2-(methacryloylamino) ethyl]tri-methylammonium chloride, [2-(methacryloylamino)ethyl]tri-methylammonium fluoride, [2-(methacryloylamino)ethyl]tri-methylammonium bromide, [2-(methacryloylamino)ethyl]tri-methylammonium iodine, [2-(methacryloylamino)ethyl]tri-methylammonium bisulfate, [2-(methacryloylamino)ethyl]tri-methylammonium alkyl sulfate, [2-(methacryloylamino)ethyl]tri-methylammonium dihydrogen phosphate, [2-(methacryloylamino)

ethyl]tri-methylammonium hydrogen alkyl phosphate, [2-(methacryloylamino)ethyl]tri-methylammonium dialkyl phosphate, and combinations thereof.

Further, the second cationic structural unit can be derived from APTAS, which include, for example, acrylamidopropyl trimethyl ammonium chloride (APTAC), acrylamidopropyl trimethyl ammonium fluoride, acrylamidopropyl trimethyl ammonium bromide, acrylamidopropyl trimethyl ammonium iodine, acrylamidopropyl trimethyl ammonium bisulfate, acrylamidopropyl trimethyl ammonium alkyl sulfate, acrylamidopropyl trimethyl ammonium dihydrogen phosphate, acrylamidopropyl trimethyl ammonium hydrogen alkyl phosphate, acrylamidopropyl trimethyl ammonium dialkyl phosphate, and combinations thereof.

Still further, the second cationic structural unit can be derived from a MAPTAS, which includes, for example, methacrylamidopropyl trimethylammonium chloride (MAPTAC), methacrylamidopropyl trimethylammonium fluoride, methacrylamidopropyl trimethylammonium bromide, methacrylamidopropyl trimethylammonium iodine, methacrylamidopropyl trimethylammonium bisulfate, methacrylamidopropyl trimethylammonium alkyl sulfate, methacrylamidopropyl trimethylammonium dihydrogen phosphate, methacrylamidopropyl trimethylammonium hydrogen alkyl phosphate, methacrylamidopropyl trimethylammonium dialkyl phosphate, and combinations thereof.

More preferably, the second cationic structural unit is derived from DADMAC, MAPTAC, APTAC, or QVi. Most preferably, the second cationic structural unit as mentioned herein is made directly from DADMAC.

The second cationic structural unit is present in the cationic polymer in an amount ranging from about 1 mol % to about 95 mol %, preferably from about 2 mol % to about 75 mol %, more preferably from about 3 mol % to about 55 mol %, and most preferably from about 4 mol % to about 40 mol %.

The additional third structural unit, which is optional for the cationic polymer of the present invention, is a nonionic structural unit derived from a vinyl-based nonionic monomer, such as vinylpyrrolidone (VP), vinyl acetate, vinyl alcohol, vinyl formamide, vinyl acetamide, vinyl alkyl ether, vinyl pyridine, vinyl imidazole, vinyl caprolactam, and combinations thereof. More preferably, the third nonionic structural unit of the cationic polymer is derived from VP. The cationic polymer may contain from about 0 mol % to about 95 mol %, preferably from about 0 mol % to about 90 mol %, and more preferably from about 0 mol % to about 85 mol % of the third nonionic structural unit.

In a specific embodiment of the present invention, the cationic polymer does not contain any of the third nonionic structural unit (i.e., the third nonionic structural unit is present at 0 mol %) and consists essentially only of the first and second structural units as described hereinabove. For example, such cationic polymer can be a copolymer consisting essentially of: (i) from about 60 mol % to about 95 mol %, and preferably from about 65 mol % to about 90 mol %, of the AAm-derived first structural unit; (ii) from about 5 mol % to about 40 mol %, and preferably from about 10 mol % to about 35 mol %, of the second cationic structural unit as described hereinabove; and (iii) 0 mol % of the third nonionic structural unit.

In another specific embodiment of the present invention, the cationic polymer contains the first, second and third structural units as described hereinabove, and is substantially free of any other structural unit. For example, such cationic polymer can be a terpolymer consisting essentially of: (i) from about 60 mol % to about 95 mol %, and preferably from about 65 mol % to about 90 mol %, of the first nonionic AAm-derived structural unit as described hereinabove; (ii) from about 5 mol % to about 25 mol %, and preferably from about 10 mol % to about 35 mol %, of the second cationic structural unit as described hereinabove; and (iii) from about 0.1 mol % to about 86 mol %, and preferably from about 3 mol % to about 60 mol %, of the third nonionic structural unit as described hereinabove.

The preferred molar percentage ranges of the first, second, and optionally third structural units of the cationic polymer as specified hereinabove may help to further improve the sudsing profile generated by the laundry detergent compositions containing such cationic polymer during the wash and rinse cycles.

Molecular weights of the cationic polymers may also be modulated to help improving sudsing profile. Further, by modulating or controlling the molecular weights of the cationic polymers of the present invention, the whiteness loss that is commonly seen in fabrics after they have been exposed to multiple washes can be reduced or minimized Cationic polymers have been known to contribute to fabric whiteness loss, which is a limiting factor for wider usage of such polymers. However, inventors of the present invention have discovered that by controlling the molecular weight of the cationic polymer within a specific range, i.e., from about 1,000 to about 1,500,000 Daltons, preferably from about 10,000 to about 1,200,000 Daltons, and more preferably from about 20,000 to about 600,000 Daltons, the fabric whiteness loss can be effectively reduced in comparison with conventional cationic polymers.

The cationic polymer can be present in the detergent or cleaning composition of the present invention in an amount ranging from about 0.005% to about 10%, preferably about 0.01% to about 5%, more preferably from about 0.05% to about 3%, and most preferably from about 0.1% to about 1%, by total weight of the detergent or cleaning composition. In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the cationic polymer is preferably present in an amount ranging from about 0.2% to about 30%, more preferably from about 0.5% to about 20%, and most preferably from 1% to about 15%, by total weight of such concentrated liquid laundry detergent composition.

Organomodified Silicone Comprising Aryl Moieties

The detergent or cleaning composition of the present invention further contains an organomodified silicone comprising one or more aryl moieties each comprising a 5- to 9-membered aromatic ring. Such an aromatic ring can be either substituted or unsubstituted, either heteroatomic or homoatomic, either monocyclic or multicyclic. For example, the aromatic ring can be selected from the group consisting of phenyl, furan, pyrrole, thiophene, imidazole, pyrazole, oxazole, pyridine, pyrazine, naphthalene, anthracene moieties, and derivatives thereof. Preferably, the aromatic ring is substituted with at least one aliphatic group. In a particularly preferred embodiment of the present invention, such one or more aryl moieties are selected from alkylphenyl moieties, and more preferably such one or more aryl moieties are 2-phenylpropyl moieties, which is also commonly referred to as alpha-methylstyrene moieties.

The organomodified silicone may further comprise one or more $C_2$-$C_{20}$ aliphatic moieties, and preferably one or more $C_6$-$C_{10}$ alkyl moieties, which can be either substituted or unsubstituted, either heteroatomic or homoatomic.

Said organomodified silicone may comprise units of the following formula (I):

$$R_a(R^1O)_bR^2_cSiO_{(4-a-b-c)/2} \quad (I)$$

wherein:

a) each R is independently selected from the group consisting of: H; the aryl moieties as described hereinabove, which contain a substituted aromatic ring with at least one aliphatic group and is covalently attached to a silicon atom of the organomodified silicone via the aliphatic groups; and a monovalent, SiC-bonded aliphatic hydrocarbon radical, which is optionally substituted and optionally comprises a heteroatom;

b) each $R^1$ is independently selected from the group consisting of: H; and a monovalent aliphatic hydrocarbon radical, which is optionally substituted and optionally comprises a heteroatom;

c) each $R^2$ is independently selected from the group consisting of: H; the aryl moieties as described hereinabove, which contain a substituted aromatic ring with at least one aliphatic group and is covalently attached to a silicon atom of the organomodified silicone via the aliphatic groups; the aryl moieties as described hereinabove, which contain a substituted atomic ring and is covalently attached to a silicon atom of the organomodified silicone via a carbon ring atom; and a monovalent, SiC-bonded aliphatic hydrocarbon radical, which is optionally substituted and optionally comprises a heteroatom;

d) the index a is 0, 1, 2 or 3;

e) the index b is 0, 1, 2 or 3; and f) the index c is 0, 1, 2 or 3.

The sum of a+b+c is typically less than or equal to 3, and it is preferably an average of from about 1.5 to about 2.4, more preferably an average of from about 1.8 to about 2.3, and most preferably from about 1.9 to about 2.1. The organomodified silicone may comprise from about 5 to about 10,000, preferably from about 10 to about 5,000, and more preferably from about 50 to about 1,000, and most preferably from about 100 to about 500, siloxane units of formula (I).

In a preferred embodiment of the present invention, the organomodified silicone comprises a sufficient number of R and $R^2$ moieties that comprise the preferred aryl moieties to provide from about 1 mol % to about 75 mol % of siloxane units with 2-phenylpropyl moieties attached thereto and from about 1 mol % to about 20 mol % of siloxane units with $C_6$-$C_{10}$ alkyl moieties attached thereto, provided that none of the 2-phenylpropyl moieties and none of the $C_6$-$C_{10}$ alkyl moieties are attached to the same silicon atom. More preferably, the organomodified silicone contains from about 5 mol % to about 50 mol % or from about 10 mol % to about 40 mol % of siloxane units with 2-phenylpropyl moieties attached thereto, and from about 2 mol % to about 15 mol % or from about 3 mol % to about 10 mol % of siloxane units with $C_6$-$C_{10}$ alkyl moieties attached thereto. Most preferably, the organomodified silicone contains from about 15 mol % to about 25 mol % of the 2-phenylpropyl moieties and from about 4 mol % to about 8 mol % of $C_6$-$C_{10}$ alkyl moieties. Please note that the total mol % of all siloxane units, either substituted or unsubstituted, in the organomodified silicone adds to 100 mol %.

The weight average molecular weight of the organomodified silicone of the present invention may range from about 1,000 to about 500,000, preferably from about 5,000 to about 200,000, more preferably from about 10,000 to about 150,000, and most preferably from about 50,000 to about 100,000, Daltons. The number average molecular weight of the organomodified silicone of the present invention may range from about 1,000 to about 500,000, preferably from about 2,000 to about 200,000, more preferably from about 5,000 to about 100,000, and most preferably from about 10,000 to about 50,000, Daltons.

The organomodified silicone can be present in the detergent or cleaning composition of the present invention in an amount ranging from about 0.01% to about 10%, preferably from about 0.03% to about 3%, more preferably from about 0.05% to about 2%, and most preferably from about 0.2% to about 0.5%, by total weight of the detergent or cleaning composition.

In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the organomodified silicone is present in an amount ranging from about 0.05% to about 30%, preferably from about 0.1% to about 15%, more preferably from 0.2% to about 10%, and most preferably from about 1% to about 5% by total weight of such concentrated liquid laundry detergent composition.

Siloxane-Based Diluent

The foam control composition of the present invention further contains a siloxane-based diluent that is characterized by a Solubility Index (calculated according to the Solubility Index Test described hereinafter) of from about 0.8 to about 1.25 in the above-described organomodified silicone. Preferably, the siloxane-based diluent is characterized by a Solubility Index of from about 0.85 to about 1.2, more preferably from about 0.9 to about 1.1, and most preferably from about 0.95 to about 1.0.

In a preferred but not necessary embodiment of the present invention, the siloxane-based diluent contains one or more polydimethylsiloxanes (PDMS) having viscosity ranging from about 0.5 cSt to about 10,000 cSt, preferably from about 1 cSt to about 1,000 cSt, more preferably from about 2 cSt to about 100 cSt, and most preferably from about 5 cSt to about 15 cSt, measured at a shear rate of 20 $sec^{-1}$ and 25° C. The PDMS can be linear, branched, cyclic, grafted or cross-linked or cyclic structures, while linear PDMS is particularly preferred.

The siloxane-based diluent can be present in the detergent or cleaning composition of the present invention in an amount ranging from about 0.005% to about 10%, preferably from about 0.02% to about 5%, more preferably from about 0.05% to about 2.5%, and most preferably from about 0.2% to about 0.5%, by total weight of the detergent or cleaning composition.

In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the siloxane-based diluent is present in an amount ranging from about 0.02% to about 30%, preferably from about 0.1% to about 20%, more preferably from about 0.2% to about 10%, and most preferably from about 1% to about 5%, by total weight of such concentrated liquid laundry detergent composition.

In a particularly preferred embodiment of the present invention, the siloxane-based diluent may contain a combination of two or more PDMSs of different viscosity. For example, the siloxane-based diluent may include a first polydimethylsiloxane having a first, higher viscosity of from about 8 cSt to about 12 cSt and a second polydimethylsiloxane having a second, lower viscosity of from about 5 cSt to about 10 cSt, when measured at a shear rate of about 20 $sec^{-1}$ and about 25° C. More specifically, the first polydimethylsiloxane is present in an amount ranging from about 0.005% to about 8%, preferably from about 0.01% to about 2.5%, more preferably from about 0.05% to about 2%, and most preferably from about 0.1% to about 0.3% by total weight of the detergent or cleaning composition; and the second polydimethylsiloxane is present in an amount ranging from 0% to about 8%, preferably from about 0.005% to about 2%, more preferably from about 0.02% to about 1.2%, and most preferably from about 0.05% to about 0.25% by total weight of the detergent or cleaning composition.

Hydrophobic Silica

In a preferred but not necessary embodiment of the present invention, the detergent or cleaning composition further comprises hydrophobically modified silica particles. Such hydrophobically modified silica particles may have: (1) a surface area as measured by BET measurement of from about 50 $m^2/g$ to about 800 $m^2/g$, preferably from about 80 to 200 $m^2/g$; and (2) an average particle size ranging from about 0.5 to about 50 microns, preferably from about 1 to about 40 microns, more preferably from about 2 to about 30 microns, and most preferably from about 5 to about 25 microns.

Silica particles are typically not hydrophobic in nature, so the hydrophobically modified silica particles are formed by surface treatment of silica particles with a hydrophobing agent. The silica particles are preferably those prepared by heating, e.g., fumed silica, or by precipitation, or by a sol-gel process, while precipitated silica particles are particularly preferred. Suitable hydrophobing agents include, but are not limited to: methyl substituted organosilicone materials, fatty acids, polydimethylsiloxanes, dimethylsiloxane polymers that are end-blocked with silanol or silicon-bonded alkoxy groups, hexamethyldisilazane, hexamethyldisiloxane, and organosilicone resins. Hydrophobing of the silica particles are typically carried out at a temperature of at least 80° C. Commercially available hydrophobic silica particles include those sold under the trade names Sipemat® D10 or Sipemat® D13 from Degussa AG, Germany.

The hydrophobic silica can be present in the detergent or cleaning composition of the present invention in an amount ranging from about 0.0005% to about 1%, preferably from about 0.002% to about 0.4%, more preferably from about 0.005% to about 0.25%, and most preferably from about 0.02% to about 0.05%, by total weight of the detergent or cleaning composition.

In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the hydrophobic silica is preferably present in an amount ranging from about 0.002% to about 5%, more preferably from about 0.02% to about 1%, and most preferably from 0.1% to about 0.2%, by total weight of such concentrated liquid laundry detergent composition.

Silicone Resin

Preferably but not necessarily, the detergent or cleaning composition of the present invention may further comprise a silicone resin. The silicone resin may comprise units of formula (II) below:

$$R^3_d(R^4O)_eSiO_{(4-d-e)/2} \quad \text{(II)}$$

wherein:

a) each $R^3$ is independently selected from the group consisting of: H; a monovalent, SiC-bonded, aliphatic hydrocarbon radical that is optionally substituted and optionally comprises a heteroatom; and an aromatic hydrocarbon radical that is covalently attached to a silicon atom of the silicone resin via aliphatic groups;

b) each $R^4$ is independently selected from the group consisting of: H; a monovalent aliphatic hydrocarbon radical that is optionally substituted and optionally comprises a heteroatom;

c) the index d is 0, 1, 2 or 3; and d) the index e is 0, 1, 2 or 3.

The sum of d+e is typically less than or equal to 3, and preferably less than 30% or more preferably less than 5% of all siloxane units of formula (II) in the silicone resin have the sum of d+e=2.

More preferably, the value of d is either 3 or 0. In this manner, the silicone resin of the present invention is composed essentially of $R^3_3SiO_{1/2}$ (M) units and $SiO_{4/2}$ (Q) units, while $R^3$ is as defined hereinabove. Such resins are typically referred to as MQ resins. The molar ratio of M units to Q units is preferably from about 0.5 to about 2.0, more preferably from about 0.6 to about 1.0. These MQ resins may also contain up to 10% by weight of hydroxyl or alkoxy groups. Although it is preferred that the MQ resins are solid at room temperature, liquid MQ resins having a M/Q ratio of 1.2 or higher can also be used successfully.

The silicone resin of the present invention is preferably provided as a solution containing a non-volatile solvent. Suitable non-volatile solvents include various oils, alcohols, and esters of carboxylic acids, such as fatty acid esters. Preferred solvents include esters of carboxylic acids, such as dioctyl phthalate, diethyl succinate, methyl caproate, butyl perlargonate, ethyl stearate, 2-ethylhexyl stearate, dodecyl laurate, methyl melissate, and the like.

For more details regarding the organomodified silicone, the siloxane-based diluent, the hydrophobically modified silica, the silicone resin, and the solvent, please see US2011/0209291, U.S. Pat. No. 7,566,750, and U.S. Pat. No. 8,536,109.

The silicone resin can be present in the detergent or cleaning composition of the present invention in an amount ranging from about 0.0005% to about 1%, preferably from about 0.001% to about 0.5%, more preferably from about 0.005% to about 0.1%, and most preferably from about 0.01% to about 0.05%, by total weight of the detergent or cleaning composition.

In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the silicone resin is preferably present in an amount ranging from about 0.002% to about 5%, more preferably from about 0.02% to about 0.5%, and most preferably from 0.05% to about 0.2%, by total weight of such concentrated liquid laundry detergent composition.

Solvent for the Silicone Resin

Preferably but not necessarily, the detergent or cleaning composition of the present invention may further comprise a solvent for the silicone resin. Suitable emulsifiers are non-volatile organic solvents, including alcohols such as dodecanol, 2-butyl-octanol and the like, or fatty acid esters such as octyl stearate, 2-ethylhexyl stearate and the like. A particularly preferred solvent is 2-ethylhexyl stearate.

The solvent can be present in the detergent or cleaning composition of the present invention in an amount ranging from 0% to about 0.5%, preferably from about 0.001% to about 0.2%, more preferably from about 0.005% to about 0.1%, and most preferably from about 0.01% to about 0.05%, by total weight of the detergent or cleaning composition.

In the event that such detergent or cleaning composition is a concentrated liquid laundry detergent composition, e.g., as a part of a unit-dose laundry detergent product (i.e., encapsulated by a single compartment or multi-compartment water-soluble pouch formed of a water-soluble polymeric film), the solvent is present in an amount ranging from about 0% to about 5%, more preferably from about 0.02% to about 0.5%, and most preferably from 0.05% to about 0.2%, by total weight of such concentrated liquid laundry detergent composition.

Detergent or Cleaning Compositions

The detergent or cleaning composition of the present invention can be hard surface cleaners, such as for example, dish washing detergents, and those used in the health and beauty areas, including shampoos and soaps, which may benefit from products having improved sudsing profiles. In another aspect, the cleaning composition is suitable for laundry detergent application, for example: laundry, including automatic washing machine laundering or hand-washing, or cleaning auxiliaries, such as for example, bleach, rinse aids, additives or pre-treat types.

The cleaning or laundry detergent compositions can be in any form, namely, in the form of a liquid; a solid such as a powder, granules, agglomerate, paste, tablet, pouches, bar, gel; an emulsion; types delivered in dual- or multi-compartment containers or pouches; a spray or foam detergent; premoistened wipes (i.e., the cleaning composition in combination with a nonwoven material); dry wipes (i.e., the cleaning composition in combination with a nonwoven materials) activated with water by a consumer; and other homogeneous or multiphase consumer cleaning product forms.

The laundry detergent composition is preferably a liquid laundry detergent and can be a fully formulated laundry detergent product. Liquid compositions contained in encapsulated and/or unitized dose products are included, as are compositions which comprise two or more separate but jointly dispensable portions. More preferably, the laundry detergent composition is a liquid laundry detergent composition designed for hand-washing, where the improved suds benefit or superior sudsing profile is most evident to the consumer. The liquid laundry detergent composition preferably contains water as an aqueous carrier, and it can contain either water alone or mixtures of organic solvent(s) with water as carrier(s). Suitable organic solvents are linear or branched lower $C_1$-$C_8$ alcohols, diols, glycerols or glycols; lower amine solvents such as $C_1$-$C_4$ alkanolamines, and mixtures thereof. Exemplary organic solvents include 1,2-propanediol, ethanol, glycerol, monoethanolamine and triethanolamine. The carriers are typically present in a liquid composition at levels in the range of from about 0.1% to about 98%, preferably from about 10% to about 95%, more preferably from about 25% to about 75% by total weight of the liquid composition. In some embodiments, water is from about 85 to about 100 wt % of the carrier. In other embodiments, water is absent and the composition is anhydrous. Highly preferred compositions afforded by the present invention are clear, isotropic liquids.

The liquid laundry detergent composition of the present invention has a viscosity from about 1 to about 2000 centipoise (1-2000 mPa·s), or from about 200 to about 800 centipoises (200-800 mPa·s). The viscosity can be determined using a Brookfield viscometer, No. 2 spindle, at 60 RPM/s, measured at 25° C.

In addition to the ingredients described hereinabove, the detergent or cleaning compositions of the present invention may comprise one or more surfactants at amounts ranging from about 1% to about 80%, more preferably from about 1% to about 50%, and more preferably from about 5% to about 30% by total weight of the compositions. Detersive surfactants utilized can be of the anionic, nonionic, zwitterionic, amphoteric or cationic type or can comprise compatible mixtures of these types.

Anionic and nonionic surfactants are preferred. Useful anionic surfactants can themselves be of several different types. For example, water-soluble salts of the higher fatty acids, i.e., "soaps", are useful anionic surfactants in the compositions herein. This includes alkali metal soaps such as the sodium, potassium, ammonium, and alkyl ammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. Additional non-soap anionic surfactants which are suitable for use herein include the water-soluble salts, preferably the alkali metal, and ammonium salts, of organic sulfuric reaction products having in their molecular structure an alkyl group (included in the term "alkyl" is the alkyl portion of acyl groups) containing from about 10 to about 20 carbon atoms and a sulfonic acid or sulfuric acid ester group. Examples of this group of synthetic anionic surfactants include, but are not limited to: a) the sodium, potassium and ammonium alkyl sulfates with either linear or branched carbon chains, especially those obtained by sulfating the higher alcohols ($C_{10}$-$C_{20}$ carbon atoms), such as those produced by reducing the glycerides of tallow or coconut oil; b) the sodium, potassium and ammonium alkylethoxy sulfates with either linear or branched carbon chains, particularly those in which the alkyl group contains from about 10 to about 20, preferably from about 12 to about 18 carbon atoms, and wherein the ethoxylated chain has, in average, a degree of ethoxylation ranging from about 0.1 to about 5, preferably from about 0.3 to about 4, and more preferably from about 0.5 to about 3; c) the sodium and potassium alkyl benzene sulfonates in which the alkyl group contains from about 10 to about 20 carbon atoms in either a linear or a branched carbon chain configuration, preferably a linear carbon chain configuration; d) the sodium, potassium and ammonium alkyl sulphonates in which the alkyl group contains from about 10 to about 20 carbon atoms in either a linear or a branched configuration; e) the sodium, potassium and ammonium alkyl phosphates or phosphonates in which the alkyl group contains from about 10 to about 20 carbon atoms in either a linear or a branched configuration, f) the sodium, potassium and ammonium alkyl carboxylates in which the alkyl group contains from about 10 to about 20 carbon atoms in either a linear or a branched configuration, and combinations thereof. Especially preferred for the practice of the present invention are surfactant systems containing $C_{10}$-$C_{20}$ linear alkyl benzene sulphonates, $C_{10}$-$C_{20}$ linear or branched alkylethoxy sulfates having an average degree of ethoxylation ranging from 0.1 to about 5 (preferably from about 0.3 to about 4 and more preferably from about 0.5 to about 3, which is particularly advantageous for improving the sudsing profile of the detergent composition), or mixtures thereof. The anionic surfactants can be provided in the cleaning compositions of the present invention at levels ranging from 1% to about 80%, more preferably from about 1% to about 50%, and more preferably from about 5% to about 30% by total weight of the compositions.

Preferred nonionic surfactants are those of the formula $R^1(OC_2H_4)_nOH$, wherein $R^1$ is a $C_8$-$C_{18}$ alkyl group or alkyl phenyl group, and n is from about 1 to about 80. Particularly preferred are $C_8$-$C_{18}$ alkyl alkoxylated alcohols having an average degree of alkoxylation from 1 to 20. The nonionic surfactants can be provided in the cleaning compositions at levels ranging from 0.05 wt % to 5 wt %, preferably from 0.1 wt % to 2 wt %.

Other surfactants useful herein include amphoteric surfactants and cationic surfactants. Such surfactants are well known for use in laundry detergents and are typically present at levels from about 0.2 wt % or 1 wt % to about 40 wt % or 50 wt %.

In one particularly preferred embodiment, the detergent or cleaning composition of the present invention is a liquid laundry detergent composition containing from about 1 wt % to about 50 wt % of one or more anionic surfactants selected from the group consisting of $C_{10}$-$C_{20}$ linear alkyl benzene sulphonates, $C_{10}$-$C_{20}$ linear or branched alkylethoxy sulfates having an average degree of ethoxylation ranging from 0.5 to 3, and combinations thereof.

The liquid laundry detergent composition as described herein above may also contain an external structurant, which may be present in an amount ranging from about 0.001% to about 1.0%, preferably from about 0.05% to about 0.5%, more preferably from about 0.1% to about 0.3% by total weight of the composition. Suitable external structurants include those described, for example, in US2007/169741 and US2005/0203213. A particularly preferred external structurant for the practice of the present invention is hydrogenated castor oil, which is also referred to as trihydroxylstearin and is commercially available under the tradename Thixin®.

In yet another preferred embodiment of the present invention, the liquid laundry detergent composition further contains from about 0.1 wt % to 5 wt %, preferably from 0.5 wt % to 3 wt %, more preferably from 1 wt % to 1.5 wt %, of one or more fatty acids and/or alkali salts thereof. Suitable fatty acids and/or salts that can be used in the present invention include $C_{10}$-$C_{22}$ fatty acids or alkali salts thereof. Such alkali salts include monovalent or divalent alkali metal salts like sodium, potassium, lithium and/or magnesium salts as well as the ammonium and/or alkylammonium salts of fatty acids, preferably the sodium salt.

The balance of the laundry detergent typically contains from about 5 wt % to about 70 wt %, or about 10 wt % to about 60 wt % adjunct ingredients. Suitable detergent ingredients include: transition metal catalysts; imine bleach boosters; enzymes such as amylases, carbohydrases, cellulases, laccases, lipases, bleaching enzymes such as oxidases and peroxidases, proteases, pectate lyases and mannanases; source of peroxygen such as percarbonate salts and/or perborate salts, preferred is sodium percarbonate, the source of peroxygen is preferably at least partially coated, preferably completely coated, by a coating ingredient such as a carbonate salt, a sulphate salt, a silicate salt, borosilicate, or mixtures, including mixed salts, thereof; bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; suds suppressing systems such as silicone based suds suppressors; brighteners; hueing agents; photobleach; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as oligomers produced by the condensation of imidazole and epichlorhydrin; soil dispersants and soil anti-redeposition aids such as alkoxylated polyamines and ethoxylated ethyleneimine polymers; anti-redeposition components such as polyesters and/or terephthalate polymers, polyethylene glycol including polyethylene glycol substituted with vinyl alcohol and/or vinyl acetate pendant groups; perfumes such as perfume microcapsules, polymer assisted perfume delivery systems including Schiff base perfume/polymer complexes, starch encapsulated perfume accords; soap rings; aesthetic particles including coloured noodles and/or needles; dyes; fillers such as sodium sulphate, although it may be preferred for the composition to be substantially free of fillers; carbonate salt including sodium carbonate and/or sodium bicarbonate; silicate salt such as sodium silicate, including 1.6R and 2.0R sodium silicate, or sodium metasilicate; co-polyesters of di-carboxylic acids and diols; cellulosic polymers such as methyl cellulose, carboxymethyl cellulose, hydroxyethoxycellulose, or other alkyl or alkylalkoxy cellulose, and hydrophobically modified cellulose; carboxylic acid and/or salts thereof, including citric acid and/or sodium citrate; and any combination thereof.

It may also be especially preferred for the laundry detergent powder to comprise low levels, or even be essentially free, of builder. The term "essentially free" means that the composition "comprises no deliberately added" amount of that ingredient. In a preferred embodiment, the laundry detergent composition of the present invention comprises no builder.

Method of Making the Detergent or Cleaning Composition

Incorporation of the above-described components and various other ingredients as described hereinabove into the detergent or cleaning compositions of the invention can be done in any suitable manner and can, in general, involve any order of mixing or addition.

For example, the cationic polymer, the organomodified silicone, the siloxane-based diluent, the hydrophobically modified silica, the silicone resin and the solvent as received from the manufacturer can be mixed first with a surfactant, such as an alkylalkoxy sulfate and preferably an alkylethoxy sulfate having a weight average degree of ethoxylation ranging from 0.1 to 5.0, to form a foam control composition, which is then mixed with two or more of the other components to form the final detergent or cleaning composition. In another example, the cationic polymer, the organomodified silicone, the siloxane-based diluent, the hydrophobically modified silica, the silicone resin, and the solvent can be simultaneously mixed with two or more of the other components to form the final detergent or cleaning composition in one mixing step. In yet another example, the cationic polymer can be premixed with an emulsifier, a dispersing agent or a suspension agent to form an emulsion, a latex, a dispersion, a suspension, and the like, which is then mixed with a foam control composition formed by premixing the organomodified silicone, the siloxane-based diluent, the hydrophobically modified silica, the silicone resin, and the solvent, followed by yet another mixing step with other components to form the final detergent or cleaning composition. These components can be added in any order and at any point in the process of preparing the final composition.

Methods of Using the Laundry Detergent Composition

The present invention is directed to a method of cleaning fabric, the method comprising the steps of: (i) providing a laundry detergent composition as described above; (ii) forming a laundry liquor by diluting the laundry detergent composition with water; (iii) washing fabric in the laundry liquor; and (iv) rinsing the fabric in water, wherein after 2 or less rinses, preferably after 1 rinse, the laundry liquor is substantially free of suds, or at least 75%, preferably at least 85%, more preferably 95%, and even more preferably at least 99% of a surface area of the laundry liquor is free from suds.

The present invention is also directed to a method of saving water during laundering, the method comprising the steps of: (i) providing a laundry detergent as described above; (ii) diluting the cleaning composition with wash water in a container to form a laundry liquor; (iii) washing laundry in the laundry liquor; and (iv) rinsing the laundry, wherein after 2 or less rinses, preferably after 1 rinse, the laundry liquor is substantially free of suds.

The method of laundering fabric may be carried out in a top-loading or front-loading automatic washing machine, or can be used in a hand-wash laundry application, which is particularly preferred in the present invention.

Test Methods

Various techniques are known in the art to determine the properties of the compositions of the present invention comprising the cationic polymer. However, the following assays must be used in order that the invention described and claimed herein may be fully understood.

Test 1: Solubility Index Test—Measuring the Miscibility or Solubility of Materials in Organomodified Silicones Via UV-Vis % Transmittance The Solubility Index is determined by measuring the percentage of light transmittance through samples using a UV-Vis Spectrophotometer operated in transmission mode, at 480 nm, using 1 cm path length cuvettes, in accordance with the following procedure. Suitable instruments include the Beckman Coulter model DU 800 UV-Vis Spectrophotometer (Beckman Coulter Inc., Brea, Calif., USA).

All sample preparations and analyses are conducted in a laboratory with air temperature of 22° C.+/−2° C. In a glass scintillation vial combine the predominant organocompatible silicone present in the composition, along with the material to be tested (for example, a polydimethyl siloxane polymer), at the ratio of 80:20 vol/vol. Cap the vial, and mix the materials thoroughly for 5 minutes using a benchtop vortex mixer set to its highest speed. If two or more distinct layers of materials are clearly visible by eye in the vial after mixing, then the Solubility Index of the test material is considered to be indeterminate via this method. If distinct layers are not clearly visible by eye, then continue with the analysis.

Turn on the spectrophotometer lamps and allow them to warm up for 30 minutes prior to commencing measurements. Set the instrument to collect the measurement in Percentage Transmission (% T) mode, at a wavelength of 480 nm Load all samples into 1 cm path length plastic cuvettes. If air bubbles are visible in the cuvettes, use a pipette to remove the bubbles, or let the bubbles settle out of the cuvette prior to measurement.

Zero the baseline for a neat sample of the organocompatible silicone by using a cuvette loaded with deionized (DI) water along with a cuvette loaded with the neat silicone. Measure the % T of the neat organocompatible silicone. Measure the % T of the mixture of organocompatible silicone and test sample, as prepared under the previous instructions. Compare the % T of the mixture of organocompatible silicone and test sample, to the % T of the neat organomodified silicone (which was measured using a DI water blank as a baseline).

The Solubility Index is reported as a decimal number, and is calculated as the % T of the mixture of organocompatible silicone and test sample, divided by the % T of the neat organocompatible silicone. For example, Solubility Index of a specific Test Sample A=% T of ABC in Organocompatible Silicone/% T of the Organocompatible Silicone=85%/98%=0.867

Test 2: Measurement of Weight Average Molecular Weight (Mw)

The weight-average molecular weight (Mw) of a polymer material of the present invention is determined by Size Exclusion Chromatography (SEC) with differential refractive index detection (RI). One suitable instrument is Agilent® GPC-MDS System using Agilent® GPC/SEC software, Version 1.2 (Agilent, Santa Clara, USA). SEC separation is carried out using three hydrophilic hydroxylation polymethyl methacrylate gel columns (Ultrahydrogel 2000-250-120 manufactured by Waters, Milford, USA) directly joined to each other in a linear series and a solution of 0.1M sodium chloride and 0.3% trifluoroacetic acid in DI-water, which is filtered through 0.22 μm pore size GVWP membrane filter (MILLIPORE, Massachusetts, USA). The RI detector needs to be kept at a constant temperature of about 5-10° C. above the ambient temperature to avoid baseline drift. It is set to 35° C. The injection volume for the SEC is 100 μL. Flow rate is set to 0.8 mL/min. Calculations and calibrations for the test polymer measurements are conducted against a set of 10 narrowly distributed Poly(2-vinylpyridin) standards from Polymer Standard Service (PSS, Mainz Germany) with peak molecular weights of: Mp=1110 g/mol; Mp=3140 g/mol; Mp=4810 g/mol; Mp=11.5 k g/mol; Mp=22 k g/mol; Mp=42.8 k g/mol; Mp=118 k g/mol; Mp=256 k g/mol; Mp=446 k g/mol; and Mp=1060 k g/mol.

Each test sample is prepared by dissolving the concentrated polymer solution into the above-described solution of 0.1M sodium chloride and 0.3% trifluoroacetic acid in DI water, to yield a test sample having a polymer concentration of 1 to 2 mg/mL. The sample solution is allowed to stand for 12 hours to fully dissolve, and then stirred well and filtered through a 0.45 μm pore size nylon membrane (manufactured by WHATMAN, UK) into an auto sampler vial using a 5 mL syringe. Samples of the polymer standards are prepared in a similar manner. Two sample solutions are prepared for each test polymer. Each solution is measured once. The two measurement results are averaged to calculate the Mw of the test polymer.

For each measurement, the solution of 0.1M sodium chloride and 0.3% trifluoroacetic acid in DI water is first injected onto the column as the background. A correction sample (a solution of 1 mg/mL polyethylene oxide with Mp=111.3 k g/mol) is analysed six times prior to other sample measurements, so as to verify repeatability and accuracy of the system.

The weight-average molecular weight (Mw) of the test sample polymer is calculated using the software that accompanies the instrument and selecting the menu options appropriate for narrow standard calibration modelling. A third-order polynomial curve is used to fit the calibration curve to the data points measured from the Poly(2-vinylpyridin) standards. The data regions used for calculating the weight-average molecular weight are selected based upon the strength of the signals detected by the RI detector. Data regions where the RI signals are greater than 3 times the respective baseline noise levels are selected and included in the Mw calculations. All other data regions are discarded and excluded from the Mw calculations. For those regions which fall outside of the calibration range, the calibration curve is extrapolated for the Mw calculation.

To measure the average molecular weight of a test sample containing a mixture of polymers of different molecular weights, the selected data region is cut into a number of equally spaced slices. The height or Y-value of each slice from the selected region represents the abundance (Ni) of a specific polymer (i), and the X-value of each slice from the selected region represents the molecular weight (Mi) of the specific polymer (i). The weight average molecular weight (Mw) of the test sample is then calculated based on the equation described hereinabove, i.e., Mw=(Σi Ni Mi2)/(Σi Ni Mi).

Test 3: Qualification of the Monomers by HPLC

Each of the monomers in the cationic polymer are quantified by high pressure liquid chromatography (HPLC) according to the follows:

| | |
|---|---|
| Measuring device: | L-7000 series (Hitachi Ltd.) |
| Detector: | UV detector, L-7400 (Hitachi Ltd.) |
| Column: | SHODEX RSpak DE-413 (product of Showa Denko K.K.) |
| Temperature: | 40° C. |
| Eluent: | 0.1% phosphoric acid aqueous solution |
| Flow Velocity: | 1.0 mL/min |

Test 4: Sudsing Profile Test

The sudsing profile of the detergent or cleaning composition of the present invention is measured by employing a suds cylinder tester (SCT). The SCT has a set of 8 cylinders. Each cylinder is typically 32 cm long and 10 cm in diameter and may be together rotated at a rate of 20-22 revolutions per minute (rpm). This method is used to assay the performance of laundry detergent to obtain a reading on ability to generate suds as well as its suds stability and rinse suds performance. The following factors affect results and therefore should be controlled properly: (a) concentration of detergent in solution, (b) water hardness, (c) temperature of water, (d) speed and number of revolutions, (e) soil load in the solution, and (f) cleanliness of the inner part of the tubes.

The performance is determined by comparing the suds volume generated during the washing stage by the laundry detergent containing the foam control composition versus a laundry detergent without the foam control composition (i.e., control). The amount of suds present for the detergent alone and the detergent with the foam control composition is measured by recording the total suds height (i.e., height of suds plus wash liquor) minus the height of the wash liquor alone.

1. Weigh the required amount of product and dissolve in 0.5 liters of 16 gpg (Ca:Mg=4:1) in desired hardness for at least 15 min Dissolve the samples simultaneously.
2. Pour the sample aliquot to the tubes. Put in the rubber stopper and lock the tubes in place.
3. Spin for 10 revolutions. Lock in an upright position. Then check the suds height very quickly (~10 sec) left to right. Record the total suds height (i.e., height of the suds plus wash liquor) and the height of the wash liquor alone. This marks the after 10 revolutions data.
4. Spin for additional 20 revolutions. This marks the after 30 revolutions data. Take recordings from left to right.
5. Spin for 20 revolutions more. This marks the after 50 revolutions data. Take readings from left to right. Repeat this step one more time; thus, the data gathered are for after 70 revolutions.
6. Open the tubes. Add 1 piece of fabric stained with clay and ¼ piece of fabric stained with dirty cooking oil (DCO) into each tube. Spin for 20 revolutions. This marks the after 90 revolutions data. Take readings. Repeat this step one time; thus, the data gathered are for after 110 revolutions.

(Note: The fabric pieces stained with clay are prepared as follows:

Disperse 20 g of BJ-clay (clay collected from 15 cm below the earth surface in Beijing, China) into 80 ml of DI water via agitation to make a clay suspension.

Keep agitating the suspension during the preparation process, while brushing 2 g of such clay suspension onto the center of a piece of 10 cm*10 cm cotton fabric to form a round shape stain (d=5 cm).

The cotton fabric with clay is left dry at room temperature and then used for the performance evaluation.

The fabric pieces stained with DCO are prepared as follows:

100 grams of peanut oil is used to fry 20 grams of salty fish for 2 hrs at 150-180° C. to form the dirty cooking oil (DCO).

Brush 0.6 ml of the DCO onto the center of a piece of 10 cm*10 cm cotton fabric to form a round shape stain (d=5 cm).

Cut the 10 cm*10 cm cotton fabric into 4 equal pieces and use one for the performance evaluation.)
7. Pour 62.5 mL solution out of the tube gently into 500 mL beaker. Add 16 gpg (Ca:Mg=4:1) hardness water into the beaker. Dispose of the remaining solution and wash the tube with tap water. Pour the 500 mL solution into the same tube.
8. Spin for 20 revolutions. This marks the after 130 revolutions data. Take readings from left to right. Repeat this step one time; thus data gathered are for after 150 revolutions.
9. Pour 250 mL solution out of the tube gently into 500 mL beaker. Add 16 gpg hardness water (Ca:Mg=4:1) into the beaker. Dispose of the remaining solution and wash the tube with tap water. Pour the 500 mL solution into the same tube. Repeat steps 8. Data gathered are for 190 revolutions data.

Data Analysis: Breakdown of the Suds Category

| Flush Suds | 10 revolutions data | Flush Suds |
|---|---|---|
| Suds generation | 30-70 revolutions data | Washing Cycle |
| Suds stability | 90-110 revolutions data | Wash data analysis is focused on Suds stability |
| ⅛ Rinse | 130-150 revolutions data | Rinsing Cycle: Rinse data analysis is focused on Rinse (⅛) |
| 1/16 Rinse | 170-190 revolutions data | Rinsing Cycle: 1/16 Rinse |

Washing Suds Index (WSI) is calculated by the suds height generated by the control sample ($WSH_C$) during the wash cycle when suds stability is observed (i.e., 90-110 revolutions) divided by that generated by a test sample ($WSH_T$), i.e., containing either a cationic polymer, or an organomodified silicone with the siloxane-based dilute, or both, and then converted into a percentage, as follows:

$$\text{Washing Suds Index} = \frac{WSH_T}{WSH_C} \times 100\%.$$

The WSI is indicative of how much suds is generated during the wash cycle by a test sample that may contain one or more ingredients having adverse impact on the wash suds, in comparison with the suds generated by a control sample that does not contain any of such ingredients. Therefore, the higher the WSI percentage, the more suds are generated during wash, and the better the performance.

Rinse Suds Index (RSI) is calculated by the suds height generated by the control sample ($RSH_C$) during the ⅛ rinse cycle (i.e., 130-150 revolutions) divided by that generated by a test sample ($RSH_T$), and then converted into a percentage, as follows:

$$\text{Rinse Suds Index} = \frac{RSH_T}{RSH_C} \times 100\%.$$

The RSI, on the other hand, is indicative of how much suds is left during the rinse cycle by a test sample containing one or more ingredients that may be effective in reducing the rinse suds, in comparison with the suds left by a control sample that does not contain any of such ingredients. Therefore, the lower the RSI percentage, the more suds reduction is effectuated during rinse, and the better the performance.

An Overall Sudsing Index (OSI) of a test sample versus the control sample is calculated as follows:

$$\text{Overall Sudsing Index} = \frac{WSI}{RSI} - 1$$

The OSI is indicative of how the overall sudsing profile of a test sample containing one or more ingredients that may be effective in affecting either the wash suds or the rinse suds or both is compared with the overall sudsing profile of the control sample that does not contain such ingredients. If the OSI is positive, it is indicative that the overall sudsing profile of the test sample is better than that of the control sample. If the OSI is negative, it is indicative that the overall sudsing profile of the test sample is worse than that of the control sample. The larger the OSI value, the better the sudsing profile of the test sample in comparison with the control sample.

EXAMPLES

Example 1: Exemplary Cationic Polymers

The following inventive cationic polymers are provided for formulating the detergent or cleaning compositions of the present invention:

TALBE I

| Polymer | Monomer type | Solid content (%) | Monomer Ratio (mol %) | MW (K Dalton) | Charge Density |
|---|---|---|---|---|---|
| A | AAm/DADMAC/VP | 19.7 | 80/16/4 | 165.3 | 1.86 |
| B | AAm/DADMAC/VP | 15.3 | 40.5/36.5/23 | 161.9 | 3.22 |
| C | AAm/DADMAC/VP | 14.1 | 37/16/47 | 22.8 | 1.55 |
| D | AAm/MAPTAC/VP | 15.3 | 80/5/15 | 567.3 | 0.60 |
| E | AAm/APTAC/VP | 14.1 | 80/5/15 | 1123.6 | 0.61 |
| F | AAm/Qvi/VP | 15.4 | 80/5/15 | 373.2 | 0.60 |

Example 2: A Premix of Organomodified Silicone, PDMS, Hydrophobically Modified Silica, Silicone Resin, and Solvent ("SRAF")

A premix is formed by filling a 150 ml container equipped with a stirrer with: (1) 42.70 g of an organomodified silicone having a molecular weight of approximately 65,000 and comprising 71-75 mol % dimethylsiloxane groups, 20-24 mol % 2-phenylpropylmethylsiloxane groups, 3-7 mol % octylmethylsiloxane groups and terminated with a trimethylsilyl group; (2) 28.5 g of a first polydimethylsiloxane (PDMS) having a viscosity of about 10 cSt; and (3) 2.40 g of a silicone resin having trimethylsiloxane units and SiO2 units in a M/Q ratio of about 25 0.65/1 to 0.67/1 as dissolved in 2.40 g 2-ethylhexyl stearate. The mixture is stirred until complete incorporation of the resin. Then 5.00 g of precipitated and hydrophobically modified silica is added, followed by stirring until complete incorporation of the silica. Then 20 g of a second polydimethylsiloxane having a viscosity of about 7 cSt is added and stirred until complete incorporation thereof.

Example 3: Synergistically Improved Sudsing Profile Achieved by Cationic Polymers with SRAF A base liquid detergent formulation containing the following ingredients is first provided:

TABLE II

| Ingredients | (wt %) |
|---|---|
| C24AE3S Paste | 8.320 |
| HLAS | 5.520 |
| Nonionic 24-7 | 1.210 |
| Citric Acid | 2.000 |
| Fatty acid | 1.210 |
| Builder | 3.210 |
| Boric acid | 2.100 |
| DTPA | 0.190 |
| Brightener | 0.057 |
| Hexamethylene diamine (ethoxylated, quaternized, sulfated) | 0.460 |
| 1,2 propanediol | 1.210 |
| NaOH | 3.130 |
| Preservatives | 0.016 |
| Silicone emulsion | 0.003 |
| Perfume | 0.600 |
| Colorant | 0.002 |
| Water | Balance |
| Total: | 100.000 |

The cationic polymers A-F as described hereinabove and/or the SRAF premix are mixed with AE3S at 2:2:1 ratio (based on active material) using an overhead blender or speed mixer to form a white foam control paste. The white foam control paste is then formulated into the base liquid detergent composition (Table II) to form a sample or test detergent composition for suds performance evaluation. The respective amounts of cationic polymer and SRAF are adjusted so as to provide 0.5 wt % of the polymer and 0.5 wt % of SRAF in the sample or test detergent composition for evaluation. A structurant such as hydrogenated castor oil may also be added to stabilize the sample or test detergent composition.

The Overall Suds Index (OSI) of each sample or test detergent composition formed thereby is tested using the method described in Test 3. The sample or test detergent compositions include: (1) a control composition that contains the base detergent composition alone, with neither any cationic polymer nor SRAF; (2) a comparative composition containing the base detergent composition with 0.5% SRAF alone, i.e., without any cationic polymer; (3) six comparative compositions each containing the base detergent composition with 0.5% of a cationic polymer alone, i.e., without SRAF; and (4) six inventive compositions each containing the base detergent composition with 0.5% of a cationic polymer and 0.5% SRAF.

The OSI results are summarized in the table below:

TABLE III

| Sample or Test Formulation | OSI |
|---|---|
| Base Detergent Composition (Control) | 0.00 |
| Base Detergent Composition + 0.5% SRAF (Comparative) | −0.26 |
| Base Detergent Composition + 0.5% Polymer A (Comparative) | 0.85 |
| Base Detergent Composition + 0.5% Polymer A + 0.5% SRAF (Inventive) | 2.48 |
| Base Detergent Composition + 0.5% Polymer B (Comparative) | 0.72 |
| Base Detergent Composition + 0.5% Polymer B + 0.5% SRAF (Inventive) | 2.94 |
| Base Detergent Composition + 0.5% Polymer C (Comparative) | 0.21 |
| Base Detergent Composition + 0.5% Polymer C + 0.5% SRAF (Inventive) | 0.93 |
| Base Detergent Composition + 0.5% Polymer D (Comparative) | 1.91 |
| Base Detergent Composition + 0.5% Polymer D + 0.5% SRAF (Inventive) | 2.07 |
| Base Detergent Composition + 0.5% Polymer E (Comparative) | 1.77 |
| Base Detergent Composition + 0.5% Polymer E + 0.5% SRAF (Inventive) | 2.13 |
| Base Detergent Composition + 0.5% Polymer F (Comparative) | 2.74 |
| Base Detergent Composition + 0.5% Polymer F + 0.5% SRAF (Inventive) | 2.79 |

It is clear from the OSI results provided hereinabove that the cationic polymers A-F and SRAF act together to improve the overall sudsing profile of the base detergent composition in a synergistic manner. When SRAF alone is added to the base detergent composition, it leads to a decrease, instead of an increase, in the OSI. When a cationic polymer alone is added to the base detergent composition, it leads to an increase in the OSI, but only to a limited extent. However, when SRAF and an inventive cationic polymer together are added to the base detergent composition, they result in an OSI increase that is significantly larger than that achieved by the cationic polymer alone. In other words, the SRAF, which results in poorer overall sudsing performance when added alone, functions to "spikes up" the overall sudsing performance when it is added in combination with an inventive cationic polymer of the present invention, which is both surprising and unexpected.

Example 4: Exemplary Laundry Detergent Compositions (A) Liquid Detergent Fabric Care Compositions:

Liquid detergent fabric care composition 1A-1E are made by mixing together the ingredients listed in the proportions shown:

| Ingredient (wt %) | 1A | 1B | 1C | 1D | 1E |
|---|---|---|---|---|---|
| $C_{12}$-$C_{15}$ alkyl polyethoxylate (1.8) sulfate[1] | 20.1 | 16.6 | 14.7 | 13.9 | 8.2 |
| $C_{11.8}$ linear alkylbenzene sulfonc acid[2] | — | 4.9 | 4.3 | 4.1 | 8.2 |
| $C_{16}$-$C_{17}$ branched alkyl sulfate[1] | — | 2.0 | 1.8 | 1.6 | — |
| $C_{12}$ alkyl trimethyl ammonium chloride[4] | 2.0 | | — | — | — |
| $C_{12}$ alkyl dimethyl amine oxide[5] | | 0.7 | 0.6 | — | — |
| $C_{12}$-$C_{14}$ alcohol 9 ethoxylate[3] | 0.3 | 0.8 | 0.9 | 0.6 | 0.7 |
| $C_{15}$-$C_{16}$ branched alcohol-7 ethoxylate[1] | — | — | — | — | 4.6 |
| 1,2 Propane diol[6] | 4.5 | 4.0 | 3.9 | 3.1 | 2.3 |
| Ethanol | 3.4 | 2.3 | 2.0 | 1.9 | 1.2 |
| $C_{12}$-$C_{18}$ Fatty Acid[5] | 2.1 | 1.7 | 1.5 | 1.4 | 3.2 |
| Citric acid[7] | 3.4 | 3.2 | 3.5 | 2.7 | 3.9 |
| Protease[7] (32 g/L) | 0.42 | 1.3 | 0.07 | 0.5 | 1.12 |
| Fluorescent Whitening Agent[8] | 0.08 | 0.2 | 0.2 | 0.17 | 0.18 |
| Diethylenetriamine pentaacetic acid[6] | 0.5 | 0.3 | 0.3 | 0.3 | 0.2 |
| Ethoxylated polyamine[9] | 0.7 | 1.8 | 1.5 | 2.0 | 1.9 |
| Grease Cleaning Alkoxylated Polyalkylenimine Polymer[10] | — | — | 1.3 | 1.8 | — |
| Zwitterionic ethoxylated quaternized sulfated hexamethylene diamine[11] | — | 1.5 | — | — | 0.8 |
| Hydrogenated castor oil[12] | 0.2 | 0.2 | | 0.12 | 0.3 |
| Copolymer of acrylamide and methacrylamidopropyl trimethylammonium chloride[13] | 0.3 | 0.2 | 0.3 | 0.1 | 0.3 |
| Foam control paste of Example 3 with polymer:SRAF:AES = 2:2:1 | 0.2 | 0.1 | 0.2 | 0.2 | 0.2 |
| Water, perfumes, dyes, buffers, solvents and other optional components | to 100% pH 8.0-8.2 | to 100% pH 8.0-8.2 | to 100% pH 8.0-8.2 | to 100% pH 8.0-8.2 | to 100% pH 8.0-8.2 |

(B): Liquid or Gel Detergents

Liquid or gel detergent fabric care compositions 2A-2E are prepared by mixing the ingredients listed in the proportions shown:

| Ingredient (wt %) | 2A | 2B | 2C | 2D | 2E |
|---|---|---|---|---|---|
| $C_{12}$-$C_{15}$ alkyl polyethoxylate (3.0) sulfate[1] | 8.5 | 2.9 | 2.9 | 2.9 | 6.8 |
| $C_{11.8}$ linear alkylbenzene sulfonic acid[2] | 11.4 | 8.2 | 8.2 | 8.2 | 1.2 |
| $C_{14}$-$C_{15}$ alkyl 7-ethoxylate[1] | — | 5.4 | 5.4 | 5.4 | 3.0 |
| $C_{12}$-$C_{14}$ alkyl 7-ethoxylate[3] | 7.6 | — | — | — | 1.0 |
| 1,2 Propane diol | 6.0 | 1.3 | 1.3 | 6.0 | 0.2 |
| Ethanol | — | 1.3 | 1.3 | — | 1.4 |
| Di Ethylene Glycol | 4.0 | — | — | — | — |

-continued

| Ingredient (wt %) | 2A | 2B | 2C | 2D | 2E |
|---|---|---|---|---|---|
| Na Cumene Sulfonate | — | 1.0 | 1.0 | 0.9 | — |
| $C_{12}$-$C_{18}$ Fatty Acid[5] | 9.5 | 3.5 | 3.5 | 3.5 | 4.5 |
| Citric acid | 2.8 | 3.4 | 3.4 | 3.4 | 2.4 |
| Protease (40.6 mg/g/)[7] | 1.0 | 0.6 | 0.6 | 0.6 | 0.3 |
| Natalase 200L (29.26 mg/g)[14] | — | 0.1 | 0.1 | 0.1 | — |
| Termamyl Ultra (25.1 mg/g)[14] | 0.7 | 0.1 | 0.1 | 0.1 | 0.1 |
| Mannaway 25L (25 mg/g)[14] | 0.1 | 0.1 | 0.1 | 0.1 | 0.02 |
| Whitezyme (20 mg/g)[14] | 0.2 | 0.1 | 0.1 | 0.1 | — |
| Fluorescent Whitening Agent[8] | 0.2 | 0.1 | 0.1 | 0.1 | — |
| Diethylene Triamine Penta Methylene Phosphonic acid | — | 0.3 | 0.3 | 0.3 | 0.1 |
| Hydroxy Ethylidene 1,1 Di Phosphonic acid | 1.5 | — | — | — | — |
| Zwitterionic ethoxylated quaternized sulfated hexamethylene diamine[11] | 2.1 | 1.0 | 1.0 | 1.0 | 0.7 |
| Grease Cleaning Alkoxylated Polyalkylenimine Polymer[10] | — | 0.4 | 0.4 | 0.4 | — |
| PEG-PVAc Polymer[15] | 0.9 | 0.5 | 0.5 | 0.5 | — |
| Hydrogenated castor oil[12] | 0.8 | 0.4 | 0.4 | 0.4 | 0.3 |
| Borate | — | 1.3 | — | — | 1.2 |
| 4 Formyl Phenyl Boronic Acid | — | — | 0.025 | — | — |
| Foam control paste of Example 3 with polymer:SRAF:AES = 2:2:1 | 0.4 | 0.3 | 0.3 | 0.2 | 0.3 |
| Water, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 |

[1]Available from Shell Chemicals, Houston, TX.
[2]Available from Huntsman Chemicals, Salt Lake City, UT.
[3]Available from Sasol Chemicals, Johannesburg, South Africa
[4]Available from Evonik Corporation, Hopewell, VA.
[5]Available from The Procter & Gamble Company, Cincinnati, OH.
[6]Available from Sigma Aldrich chemicals, Milwaukee, WI.
[7]Available from Genencor International, South San Francisco, CA.
[8]Available from Ciba Specialty Chemicals, High Point, NC.
[9]600 g/mol molecular weight polyethylenimine core with 20 ethoxylate groups per -NH and available from BASF (Ludwigshafen, Gennany)
[10]600 g/mol molecular weight polyethylenimine core with 24 ethoxylate groups per -NH and 16 propoxylate groups per -NH. Available from BASF (Ludwigshafen, Germany).
[11]Described in WO 01/05874 and available from BASF (Ludwigshafen, Germany)
[12]Available under the tradename ThixinR from Elementis Specialties, Highstown, NJ.
[13]Available from Nalco Chemicals, Naperville, IL.
[14]Available from Novozymes, Copenhagen, Denmark.
[15]PEG-PVA graft copolymer is a polyvinyl acetate grafted polyethylene oxide copolymer available from BASF (Ludwigshafen, Germany), having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60.

Example C: Rinse-Added Fabric Care Compositions

Rinse-Added fabric care compositions 3A-3D are prepared by mixing together ingredients shown below:

| Ingredient | 3A | 3B | 3C | 3D |
|---|---|---|---|---|
| Fabric Softener Active[1] | 16.2 | 11.0 | 16.2 | — |
| Fabric Softener Active[2] | — | — | — | 5.0 |
| Cationic Starch[3] | 1.5 | — | 1.5 | — |
| Polyethylene imine[4] | 0.25 | 0.25 | — | — |

-continued

| Ingredient | 3A | 3B | 3C | 3D |
|---|---|---|---|---|
| Quaternized polyacrylamide[5] | — | | 0.25 | 0.25 |
| Calcium chloride | 0.15 | 0. | 0.15 | — |
| Ammonium chloride | 0.1 | 0.1 | 0.1 | — |
| Foam control paste of Example 3 with polymer:SRAF:AES = 2:2:1 | 0.1 | 0.1 | 0.1 | 0.1 |
| Perfume | 0.85 | 2.0 | 0.85 | 1.0 |
| Perfume microcapsule[6] | 0.65 | 0.75 | 0.65 | 0.3 |
| Water, suds suppressor, stabilizers, pH control agents, buffers, dyes & other optional ingredients | to 100% pH = 3.0 | to 100% pH = 3.0 | to 100% pH = 3.0 | to 100% pH = 3.0 |

[1]N,N di(tallowoyloxyethyl)-N,N dimethylammonium chloride available from Evonik Corporation, Hopewell, VA.
[2]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N- hydroxyethyl N,N-dimethylammonium chloride available from Evonik Corporation, Hopewell, VA.
[3]Cationic starch based on common maize starch or potato starch, containing 25% to 95% amylose and a degree of substitution of from 0.02 to 0.09, and having a viscosity measured as Water Fluidity having a value from 50 to 84. Available from National Starch, Bridgewater, NJ
[4]Available from Nippon Shokubai Company, Tokyo, Japan under the trade name Epomin ® 1050.
[5]Cationic polyacrylamide polymer such as a copolymer of acrylamide/[2-(acryloylamino) ethyl]tri-methylammonium chloride (quaternized dimethyl aminoethyl acrylate) available from BASF, AG, Ludwigshafen under the trade name Sedipur 544.
[6]Available from Appleton Paper of Appleton, WI

Example D: Powder Detergent Compositions

Powder detergent compositions 4A-4C are prepared by mixing together ingredients shown below:

| Ingredient | 4A wt % | 4B wt % | 4C wt % |
|---|---|---|---|
| LAS (Non-sulphated anionic surfactant) | 10 | 15-16 | 7 |
| Mixture of alkyl sulphate surfactants | 1.5 | 1.5-2 | 1.5 |
| Cationic surfactant | 0-1 | 0-1.5 | 0-1 |
| Non ionic surfactant | 0-1 | 0-1.5 | 0-1 |
| Zeolite | 0-3 | 6-10 | 0-3 |
| Polymeric dispersing or soil release agents | 1-3 | 1-4 | 1-3 |
| Bleach and bleach activator | 0-5 | 4-6 | 2-3 |
| Silicate | 7-9 | — | 5-6 |
| Carbonate | 10-30 | 25-35 | 15-30 |
| Sulfate | 30-70 | 30-35 | 40-70 |
| Foam control paste of Example 3 with polymer:SRAF:AES = 2:2:1 | 0-1.5 | 0-1.5 | 0-1.5 |
| Deionized water | Balance to 100 wt % | | |

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent or cleaning composition comprising:

(a) a cationic polymer comprising a first nonionic structural unit derived from (meth)acrylamide (AAm) and a second cationic structural unit derived from an amine-containing monomer, wherein said cationic polymer further comprises a third nonionic structural unit derived from a monomer selected from the group consisting of vinylpyrrolidone (VP), vinyl acetate, vinyl alcohol, vinyl formamide, vinyl acetamide, vinyl alkyl ether, vinyl pyridine, vinyl imidazole, vinyl caprolactam, and combinations thereof;

(b) an organomodified silicone comprising one or more aryl moieties each comprising a 5- to 9-membered aromatic ring, wherein said aromatic ring can be either substituted or unsubstituted, either heteroatomic or homoatomic, either monocyclic or multicyclic; and (c) a siloxane-based diluent having a Solubility Index of from 0.8 to 1.25 in said organomodified silicone.

2. The detergent or cleaning composition of claim 1, wherein said cationic polymer comprises from 5 mol % to 99 mol % of said first nonionic structural unit.

3. The detergent or cleaning composition of claim 1, wherein the second cationic structural unit of the cationic polymer is derived from a monomer selected from the group consisting of diallyl dimethyl ammonium salts (DADMAS), N,N-dimethyl aminoethyl acrylate, N,N-dimethyl aminoethyl methacrylate (DMAM), [2-(methacryloylamino)ethyl] tri-methylammonium salts, N,N-dimethylaminopropyl acrylamide (DMAPA), N,N-dimethylaminopropyl methacrylamide (DMAPMA), acrylamidopropyl trimethyl ammonium salts (APTAS), methacrylamidopropyl trimethylammonium salts (MAPTAS), quaternized vinylimidazole (QVi), and combinations thereof.

4. The detergent or cleaning composition of claim 1, wherein said cationic polymer comprises from 1 mol % to 99 mol % of said second cationic structural unit.

5. The detergent or cleaning composition of claim 1, wherein said cationic polymer comprises from 0 mol % to 95 mol % of said third nonionic structural unit.

6. The detergent or cleaning composition of claim 1, wherein said cationic polymer is present in an amount ranging from 0.005% to 10% by total weight of the detergent or cleaning composition.

7. The detergent or cleaning composition of claim 1, wherein the aromatic ring of said one or more aryl moieties in said organomodified silicone is selected from the group consisting of phenyl, furan, pyrrole, thiophene, imidazole, pyrazole, oxazole, pyridine, pyrazine, naphthalene, anthracene moieties, and derivatives thereof.

8. The detergent or cleaning composition of claim 1, wherein said organomodified silicone further comprises one or more $C_2$-$C_{20}$ aliphatic moieties.

9. The detergent or cleaning composition of claim 1, wherein said organomodified silicone comprises from 1 mol % to 75 mol %, of siloxane units containing a 2-phenylpropyl moiety; and from 1 mol % to 20 mol %, of siloxane units containing a $C_3$-$C_{30}$ aryl moiety.

10. The detergent or cleaning composition of claim 1, wherein said organomodified silicone is present in an amount ranging from 0.01% to 10%, by total weight of the detergent or cleaning composition.

11. The detergent or cleaning composition of claim 1, wherein said siloxane-based diluent has a Solubility Index of from 0.85 to 1.2 in said organomodified silicone.

12. The detergent or cleaning composition of claim 1, wherein said siloxane-based diluent is a polydimethylsiloxane having a viscosity, at a shear rate of 20 $sec^{-1}$ and 25° C., ranging from 0.5 cSt to 10,000 cSt.

13. The detergent or cleaning composition of claim 1, wherein said siloxane-based diluent is present in an amount ranging from 0.005% to 10% by total weight of the detergent or cleaning composition.

14. A detergent or cleaning composition comprising:

(a) a cationic polymer comprising a first nonionic structural unit derived from (meth)acrylamide (AAm) and a second cationic structural unit derived from an amine-containing monomer;

(b) an organomodified silicone comprising one or more aryl moieties each comprising a 5- to 9-membered aromatic ring, wherein said aromatic ring can be either substituted or unsubstituted, either heteroatomic or homoatomic, either monocyclic or multicyclic; and (c) a siloxane-based diluent having a Solubility Index of from 0.85 to 1.25 in said organomodified silicone, wherein said siloxane-based diluent comprises a first polydimethylsiloxane having a first, higher viscosity and a second polydimethylsiloxane having a second, lower viscosity.

15. The detergent or cleaning composition of claim 14, wherein the first, higher viscosity ranges from 8 cSt to 12 cSt, and wherein the second, lower viscosity ranges from 5 cSt to 10 cSt, when measured at a shear rate of 20 $sec^{-1}$ and 25° C.

16. The detergent or cleaning composition of claim 14, wherein the first polydimethylsiloxane is present in an amount ranging from 0.005% to 8%, by total weight of the detergent or cleaning composition, and wherein the second polydimethylsiloxane is present in an amount ranging from 0% to 8%, by total weight of the detergent or cleaning composition.

17. The detergent or cleaning composition of claim 1, further comprising:

(a) hydrophobically modified silica, which is present in an amount ranging from 0.0005% to 1% by total weight of the detergent or cleaning composition;

(b) a silicone resin, which is present in an amount ranging from 0.0005% to 1% by total weight of the detergent or cleaning composition; and/or (c) optionally, a solvent for the silicone resin that is present in an amount ranging from 0% to 0.5% by total weight of the detergent or cleaning composition.

18. The detergent or cleaning product of claim 1, further comprising one or more surfactants selected from the group consisting of anionic surfactants, nonionic surfactants, cationic surfactants, amphoteric surfactants, zwitterionic surfactants, and combinations thereof.

19. The detergent or cleaning product of claim 18, comprising from 1% to 50% by weight of one or more anionic surfactants selected from the group consisting of $C_{10}$-$C_{20}$ linear alkyl benzene sulphonates, $C_{10}$-$C_{20}$ linear or branched alkylethoxy sulfates having an average degree of ethoxylation ranging from 0.1 to 5.0, $C_{10}$-$C_{20}$ linear or branched alkyl sulfates, $C_{10}$-$C_{20}$ linear or branched alkyl sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and combinations thereof.

20. The detergent or cleaning product of claim 19, further comprising from 0.05% to 5% by weight of one or more nonionic surfactants selected from the group consisting of $C_8$-$C_{18}$ alkyl alkoxylated alcohols having a weight average degree of alkoxylation ranging from 1 to 20 and combinations thereof.

21. A detergent or cleaning composition comprising:

(a) from 0.1% to 1% by weight of a cationic polymer, which is an AAm/DADMAC copolymer or an AAm/DADMAC/VP terpolymer;

(b) from 0.2% to 0.5% by weight of an organomodified silicone, which comprises from 10 mol % to 40 mol % of siloxane units containing a 2-phenylpropyl moiety and from 3 mol % to 10 mol % of siloxane units containing a $C_6$-$C_{10}$ alkyl moiety;

(c) from 0.2% to 0.5% by weight of a siloxane-based diluent having a Solubility Index of from 0.85 to 1 in said organomodified silicone, wherein said siloxane-based diluent comprises a first polydimethylsiloxane polymer having a first, higher viscosity ranging from 8 cSt to 12 cSt and a second polydimethylsiloxane polymer having a second, lower viscosity ranging from 5 cSt to 10 cSt when measured at a shear rate of 20 $sec^{-1}$ and 25° C.;

(d) from 0.02% to 0.05% by weight of a hydrophobically modified silica; and (e) from 0.01% to 0.05% by weight of a silicone resin.

* * * * *